US008006757B2

(12) United States Patent
Hackworth et al.

(10) Patent No.: US 8,006,757 B2
(45) Date of Patent: Aug. 30, 2011

(54) FLOW CONTROL SYSTEM AND METHOD FOR DOWNHOLE OIL-WATER PROCESSING

(75) Inventors: Matthew R. Hackworth, Manvel, TX (US); Matthew Garber, Sugar Land, TX (US); Alejandro Camacho, Missouri City, TX (US); Lance I. Fielder, Sugar Land, TX (US); Ryan Cox, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 128 days.

(21) Appl. No.: 12/393,030

(22) Filed: Feb. 25, 2009

(65) Prior Publication Data

US 2009/0242197 A1 Oct. 1, 2009

Related U.S. Application Data

(63) Continuation-in-part of application No. 11/953,970, filed on Dec. 11, 2007, now Pat. No. 7,814,976.

(60) Provisional application No. 60/969,066, filed on Aug. 30, 2007.

(51) Int. Cl.
*E21B 43/38* (2006.01)

(52) U.S. Cl. ..... 166/265

(58) Field of Classification Search ..... 166/265, 166/386; 210/512.1
See application file for complete search history.

(56) References Cited

U.S. PATENT DOCUMENTS 2,822,048 A 2/1958 Tausch
3,410,217 A * 11/1968 Kelley et al. ..... 417/58
3,559,740 A * 2/1971 Scaggs ..... 166/313
RE28,588 E 10/1975 Sizer et al.
4,738,313 A 4/1988 McKee
5,150,619 A 9/1992 Turner
5,693,225 A 12/1997 Lee
5,730,871 A 3/1998 Kennedy
5,830,368 A * 11/1998 Peachey ..... 210/747
5,937,946 A 8/1999 Streetman
5,961,841 A 10/1999 Bowers
5,971,004 A 10/1999 Pringle
5,996,690 A 12/1999 Shaw et al.
6,017,456 A 1/2000 Kennedy
6,033,567 A 3/2000 Lee
6,068,053 A 5/2000 Shaw
6,070,661 A 6/2000 Kennedy
6,082,452 A 7/2000 Shaw et al.
6,138,758 A * 10/2000 Shaw et al. ..... 166/265
(Continued)

FOREIGN PATENT DOCUMENTS

EP 1279795 B1 5/2008
(Continued)

*Primary Examiner* — Kenneth Thompson
*Assistant Examiner* — Sonya Bible
(74) *Attorney, Agent, or Firm* — Jim Patterson; Kevin McGoff; Tim Curington

(57) ABSTRACT

A technique is provided for processing well fluid downhole. The technique utilizes equipment for separating a well fluid downhole into a water component and an oil component. The separation of water and oil can be controlled by selecting an appropriately sized flow restrictor for use in limiting the flow of one or both of the water and the oil. Additionally, a sensor system is used to monitor a well characteristic that enables adjustment of the downhole fluid processing based on well characteristic data from the sensor system.

15 Claims, 11 Drawing Sheets

U.S. PATENT DOCUMENTS

| | | | | |
|---|---|---|---|---|
| 6,158,714 | A | 12/2000 | Lembcke | |
| 6,189,613 | B1 * | 2/2001 | Chachula et al. | 166/265 |
| 6,196,312 | B1 | 3/2001 | Collins et al. | |
| 6,277,286 | B1 * | 8/2001 | Søntvedt et al. | 166/250.03 |
| 6,336,503 | B1 * | 1/2002 | Alhanati et al. | 166/265 |
| 6,336,504 | B1 * | 1/2002 | Alhanati et al. | 166/265 |
| 6,357,525 | B1 | 3/2002 | Langseth | |
| 6,367,547 | B1 * | 4/2002 | Towers et al. | 166/265 |
| 6,547,005 | B2 * | 4/2003 | Haheim | 166/265 |
| 6,659,184 | B1 | 12/2003 | Tips | |
| 6,719,048 | B1 * | 4/2004 | Ramos et al. | 166/250.15 |
| 6,732,801 | B2 | 5/2004 | Ohmer et al. | |
| 6,755,978 | B2 | 6/2004 | Oddie | |
| 6,761,215 | B2 * | 7/2004 | Morrison et al. | 166/105.5 |
| 6,786,285 | B2 | 9/2004 | Johnson et al. | |
| 6,881,329 | B2 | 4/2005 | Amado | |
| 6,883,613 | B2 | 4/2005 | Bode | |
| 6,989,103 | B2 | 1/2006 | Mohsen | |
| 6,993,432 | B2 | 1/2006 | Jenkins | |
| 7,055,598 | B2 | 6/2006 | Ross | |
| 7,059,401 | B2 | 6/2006 | Bode | |
| 7,164,990 | B2 | 1/2007 | Bratvedt | |
| 7,314,559 | B2 | 1/2008 | Hopper | |
| 2001/0007283 | A1 * | 7/2001 | Johal et al. | 166/265 |
| 2001/0017207 | A1 * | 8/2001 | Haheim | 166/265 |
| 2002/0023750 | A1 * | 2/2002 | Lopes et al. | 166/265 |
| 2002/0059866 | A1 | 5/2002 | Grant | |
| 2002/0134554 | A1 * | 9/2002 | Schrenkel et al. | 166/372 |
| 2002/0195250 | A1 | 12/2002 | Underdown et al. | |
| 2004/0045708 | A1 * | 3/2004 | Morrison et al. | 166/265 |
| 2005/0034875 | A1 | 2/2005 | McLoughlin | |
| 2005/0087336 | A1 * | 4/2005 | Surjaatmadja et al. | 166/105.5 |
| 2005/0236324 | A1 | 10/2005 | Mildren et al. | |
| 2006/0037746 | A1 * | 2/2006 | Wright et al. | 166/265 |
| 2006/0175052 | A1 | 8/2006 | Tips | |
| 2007/0078703 | A1 | 4/2007 | Shipley | |
| 2008/0236821 | A1 | 10/2008 | Fielder | |

FOREIGN PATENT DOCUMENTS

| | | |
|---|---|---|
| GB | 2369631 | 6/2002 |
| WO | 9708459 | 3/1997 |
| WO | 0131167 | 5/2001 |
| WO | 0131167 | 10/2001 |
| WO | 2006032141 | 6/2006 |
| WO | 2006067151 | 6/2006 |

* cited by examiner

FLOW CONTROL SYSTEM AND METHOD FOR DOWNHOLE OIL-WATER PROCESSING

CROSS-REFERENCE TO RELATED APPLICATIONS

The following is a continuation-in-part of a prior patent application Ser. No. 11/953,970, filed Dec. 11, 2007, now U.S. Pat. No. 7,814,976, which is based on and claims priority to Provisional Application No. 60/969,066 that was filed on Aug. 30, 2007.

BACKGROUND

Oil well production can involve pumping a well fluid that is part oil and part water, i.e., an oil/water mixture. As an oil well becomes depleted of oil, a greater percentage of water is present and subsequently produced to the surface. The "produced" water often accounts for at least 80 to 90 percent of a total produced well fluid volume, thereby creating significant operational issues. For example, the produced water may require treatment and/or re-injection into a subterranean reservoir in order to dispose of the water and to help maintain reservoir pressure. Also, treating and disposing produced water can become quite costly.

One way to address those issues is through employment of a downhole device to separate oil and water and to re-inject the separated water, thereby minimizing production of unwanted water to surface. Reducing water produced to surface can allow reduction of required pump power, reduction of hydraulic losses, and simplification of surface equipment. Further, many of the costs associated with water treatment are reduced or eliminated.

However, successfully separating oil/water downhole and re-injecting the water is a relatively involved and sensitive process with many variables and factors that affect the efficiency and feasibility of such an operation. For example, the oil/water ratio can vary from well to well and can change significantly over the life of the well. Further, over time the required injection pressure for the separated water can tend to increase.

SUMMARY

In general, the present application provides a system and method for processing well fluid downhole. The system and methodology utilize equipment to separate a well fluid downhole into a water component and an oil component. The water component is injected into a downhole injection zone and the oil component is produced to a desired collection location. The separation of water and oil can be controlled by selecting an appropriately sized flow restrictor for use in limiting the flow of one or both of the water and the oil. Additionally, a sensor system is used to monitor a well characteristic that enables adjustment of the downhole fluid processing based on well characteristic data from the sensor system.

BRIEF DESCRIPTION OF THE DRAWINGS

Certain embodiments will hereafter be described with reference to the accompanying drawings, wherein like reference numerals denote like elements, and.

DETAILED DESCRIPTION

Figure 1:
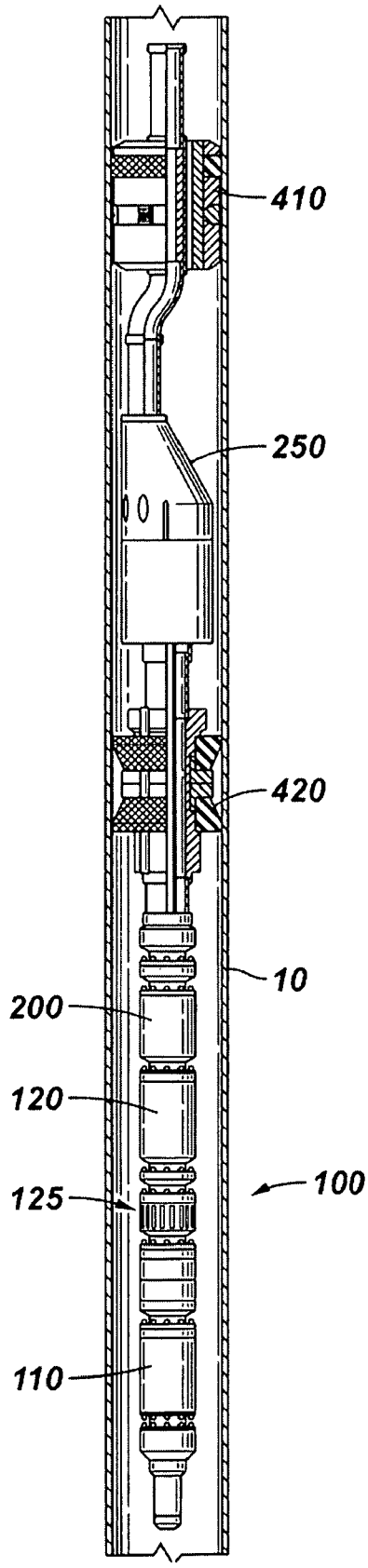
FIG. 1 is a front elevation view of a well system for downhole fluid processing, according to an embodiment.

In the following description, numerous details are set forth to provide an understanding of the present application. However, it will be understood by those of ordinary skill in the art that embodiments may be practiced without many of these details and that numerous variations or modifications from the described embodiments may be possible.

An embodiment generally relates to downhole oil/water separation, and more particularly to managing back-pressure to manipulate the oil/water separation. One way to control separation of fluids is by regulating back-pressure applied to the oil stream and/or the water stream. One way to regulate back-pressure is by regulating a flow-restriction (i.e., throttling) of the oil stream and/or the water stream exiting the oil/water separator. Embodiments herein relate to equipment that allows a stream to be throttled, i.e., a back-pressure to be manipulated. The magnitude of throttling can cover a range from completely closed to wide open depending on the oil/water content of the well fluid.

The form and function controlling backpressure and related flow is dependent upon the injection zone orientation relative to the producing zone (injection zone uphole or downhole of the producing zone). Some differences between the two orientations relate to injecting uphole where the device can throttle and vent to a tubing annulus in a single operation, and injecting downhole where the device may need to throttle the flow "in-line", i.e. receive the injection flow from the tubing, throttle the flow, and then return the flow to another tube headed toward the injection zone. Some or all of these factors can be considered. The diameter of a throttle opening can generally be from 0.125 to 1.0 inches although other diameters may be used in some applications.

In addition, a sensor system can be used to provide feedback and to facilitate the downhole fluid processing, by, for example, improving the control over backpressure which, in turn, optimizes oil and water separation. The sensor system is useful in monitoring a variety of characteristics related to the downhole fluid processing, including pressure, temperature, chemistry, vibration, fluid composition, and other characteristics. Examples of sensors that can be incorporated into the sensor system include oil-in-water sensors, sand-in-water sensors, flow meters, pressure sensors, chemistry sensors, and vibration sensors that enable the system operation to be optimized. In some applications, the sensor system also enables real-time corrections based on data provided by the sensor system to reduce the risk of system failure or damage.

In many applications, the well fluid is separated into oil and water. However the oil component may contain some or much water and, similarly, the water component may contain some oil. Oil-in-water sensing enables an operator to make adjustments to the system to balance the separation process to optimize separation efficiency. For example, a flow-restrictor can be sized to provide the desired backpressure to better optimize separation efficiency. Oil-in-water sensors measure the oil content in the injected water stream and may send the data to a surface location via a suitable communication line, such as a power cable.

For a variety of reasons, including local regulations, it may be desirable to limit oil-in-water levels for certain applications. The sensor system enables monitoring to ensure the separated water does not exceed the desired/required level of oil in the water component. The sensor system can be designed to provide an alarm or other indication to an operator to enable adjustment to the downhole fluid processing parameters. For example, adjustments can be made to the backpressure via the flow-restrictor, or adjustments can be made to other components to regulate well head pressure, to adjust speed of an electric submersible pump, or to make other adjustments. Furthermore, monitoring of the oil-in-water content of the water stream injected into an injection zone can be useful in limiting potentially harmful impacts on the injection zone. The sensor system provides operators with advance notice to enable the taking of corrective action, such as scheduling a stimulation procedure before the injection zone becomes severely plugged.

The sensor system also may comprise other sensors that facilitate optimal downhole fluid processing, such as particulate sensors. For example, in applications that produce from sandstone formations, sand can be produced and separated with the water component in the injection stream. For example, the startup procedure utilized in operating electric submersible pumping systems can impact the amount of sand produced. The ability to determine production of sand and the quantity of sand produced enables an operator to adjust the flow of the pumping system. By positioning a sand-in-water sensor in the water injection stream, the sensor can provide data to an operator that enables adjustment to the downhole fluid processing. Producing sand in the injection stream can also plug the injection zone.

In many applications, the volume of fluid injected into the injection zone is monitored and recorded. The sensor system may comprise a variety of sensors that monitor the injection flow rate along with injection pressure and temperature to enable, for example, a real-time or near real-time assessment of injection zone performance. Decreases in flow rate, for example, can be indicative of injection zone plugging or other problems that require remediation. Plugging can result from the injection of solids, scale precipitation in the wellbore or the formation, clay migration, swelling within the injection interval, accumulation of oil in the pore throats near the wellbore, or from other factors. The monitoring and recording of data from the various sensors also enables certain pressure transient analyses that can determine zonal properties, such as permeability, skin damage and reservoir extent.

The sensor system also may utilize chemical sensors for monitoring chemical properties downhole to facilitate a determination as to whether conditions exist for the precipitation of scales or corrosion. For example, measuring pH and/or the presence of certain ions using electrochemical techniques facilitates the development and optimization of scale mitigation strategies, e.g. introduction of scale inhibitor chemicals downhole via a chemical injection line. By way of example, a sensor can be located to measure the injection stream pH and to give an overall indication of the fluid condition. Chemical sensors also can be used to measure or sense the presence of corrosive chemical components, such as $H_2S$ and $CO_2$. In these applications, the sensor system incorporates chemical sensors to facilitate the development and optimization of corrosion inhibitor strategies.

FIG. 1 shows an overall schematic for an embodiment of a device. Some of the main components of the device are an electric submersible pumping system 100 comprising a motor 110 and a pump 120. A separator 200, such as a centrifugal or hydrocyclone oil/water separator, is connected adjacent to the pump 120. The apparatus is placed downhole in a hydrocarbon well and may be located inside a well casing 10. The motor 110 drives the pump 120. The motor 110 also drives the oil/water separator 200. During operation, well fluid is drawn into the pump 120 through an intake/vent 125. The oil/water mixture is driven out of the pump 120 and into the oil/water separator 200, a centrifugal type separator in this case. The oil/water separator 200 accelerates and drives the oil/water mixture in a circular path, thereby utilizing centrifugal forces to locate more dense fluids (e.g., water) to a farther out radial position and less dense fluids (e.g., oil) to a position nearer to the center of rotation. An oil stream and a water stream exit the oil/water separator 200 and travel separately along different paths to a redirector 250, where the water stream is redirected for re-injection into the formation while the oil stream is directed uphole to surface.

Figure 2:
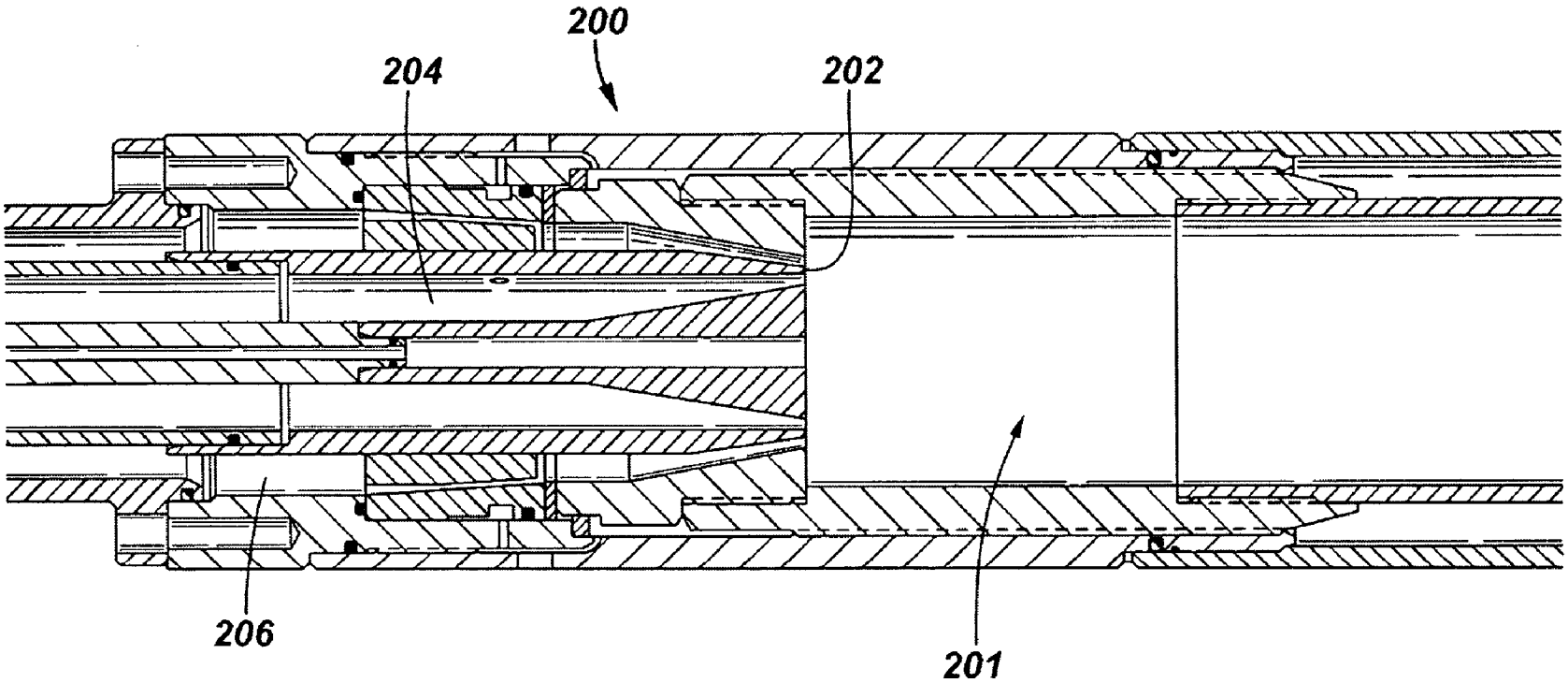
FIG. 2 is a cross-sectional view of a portion of a separator that may be used in the well system, according to an embodiment.

FIG. 2 shows a cut away view of one embodiment of the oil/water separator 200, which is of the centrifugal type. A well fluid mixture is driven into and rotated in a hydrocyclone chamber 201 of the oil/water separator 200. The layers of the stream are separated by a divider 202 that defines a beginning of an oil conduit 204 and a beginning of a water conduit 206. The oil conduit 204 is further inward in a radial direction with respect to the water conduit 206. Back-pressure of the streams affects the oil/water separation process. For example, for well fluids having a high percentage of oil, higher back-pressure for the water stream 206 can improve separation results. Similarly, for well fluids having a higher percentage of water, a higher back-pressure for the oil stream 204 can improve oil/water separation. Essentially the same back-pressure principal applies to hydrocyclone type oil/water separators.

Figure 3:
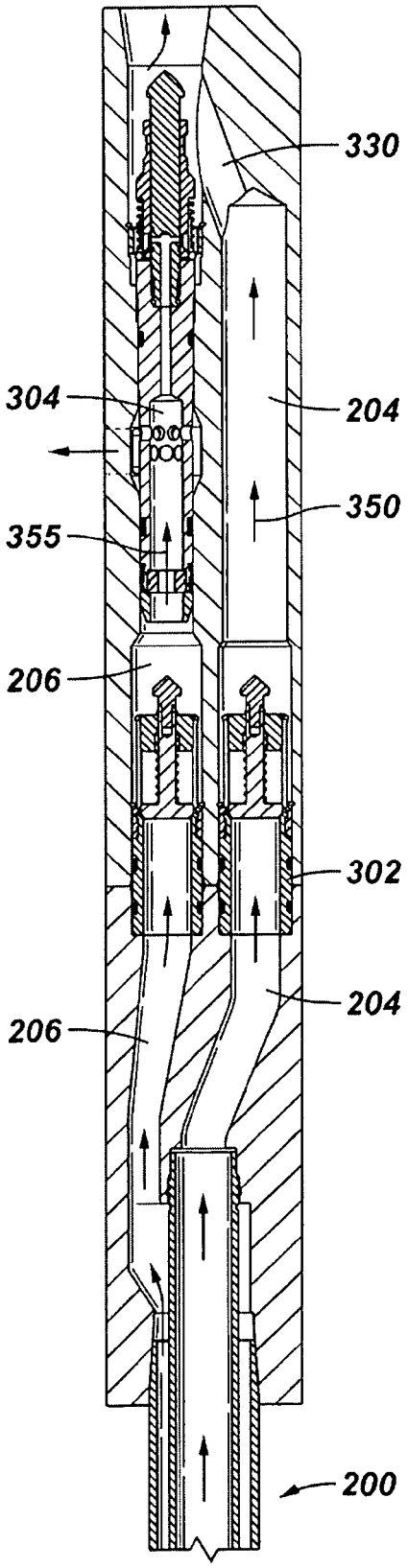
FIG. 3 is a cross-sectional view of another portion of the well system, according to an embodiment.

FIG. 3 shows another sectional view of the oil/water separator 200 having the oil conduit 204 and the water conduit 206. Arrows 350 show a representative path of the oil stream. Arrows 355 show a representative path of the water stream. A flow-restrictor 304, e.g., a throttle, is in the water conduit 206. The water stream flows uphole into the flow-restrictor 304. The flow-restrictor 304 could be located in the oil conduit 204. One flow-restrictor 304 could be in the water conduit 206 and another flow-restrictor 304 could be in the oil conduit 206 simultaneously. Selection of a flow-restrictor 304 from a number of different flow-restrictors having different variations of orifice size and configuration enables adjustment of the aforementioned backpressure in the water stream 206.

There are many ways to replace the flow-restrictor 304 with another different flow-restrictor 304 having a different throttle, thereby adjusting the backpressure situation. For example, a wireline tool can be lowered to place/remove a flow-restrictor 304. A flow-restrictor 304 can also be inserted and removed using slickline, coiled tubing, or any other applicable conveyance method. Slickline tends to be an economical choice in many applications. In connection with use of a slickline or coiled tubing, the oil stream channel can be positioned/configured to prevent tools lowered down by wireline, slickline or coiled tubing from inadvertently entering the oil conduit 204. The oil conduit 204 can be angled to prevent the tool from entering the oil conduit 204. The oil conduit 204 can further be sized such that the tool will not be accepted into the bore.

Alternately, the flow-restrictor 304 can have a variable size throttle orifice so that replacement of the flow-restrictor is not required to vary orifice size. The orifice size can be varied mechanically in many ways, e.g., at surface by hand, by a wireline tool, a slickline tool, a coil tubing tool, a hydraulic line from the surface, by an electric motor controlled by electrical signals from the surface or from wireless signals from the surface, or by an electrical motor receiving signals from a controller downhole. Check valves 302 can be located in the oil conduit 204 and/or the water conduit 206. The check valves 302 can prevent fluid from moving from the oil conduit 204 and the water conduit 206 down into the oil/water separator 200, thereby causing damage to the device. Packers can be used to isolate parts of the apparatus within the wellbore. For example, FIG. 1 shows packers 410 and 420 isolating an area where water is to be re-injected into the formation from an area where well fluid is drawn from the formation. The packer configuration effectively isolates the pump intake from re-injection fluid. Alternately, the packer 420 could be located below the pump 200, provided the water is re-injected above the packer 410 or below the packer 420, thereby adequately isolating the area where the well fluids are produced from the area of the formation where water is re-injected. No specific packer configuration is required, so long as isolation between producing fluid and injecting fluid is adequately achieved.

Figure 4:
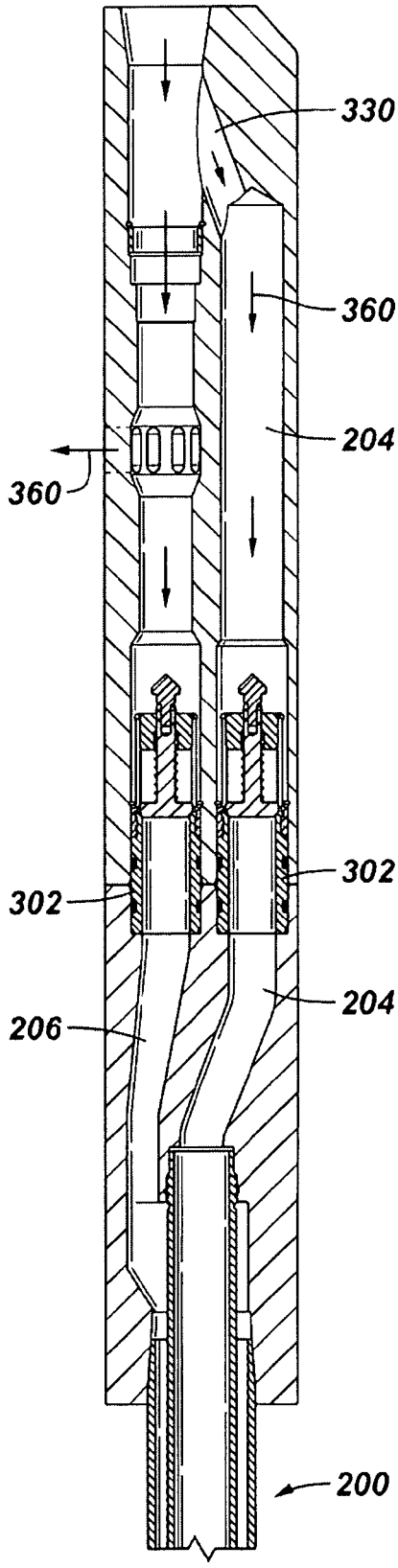
FIG. 4 is a view similar to that of FIG. 3 but showing alternate fluid flow, according to an embodiment.

The above noted configurations also can be used to inject stimulation treatments downhole. FIG. 4 shows the apparatus of FIG. 3 except with the flow-restrictor 304 removed. FIG. 4 shows pumping of stimulating treatments down the completion tubing and into both the oil conduit 204 and the water conduit 206. A flow-restrictor can be replaced with a flow device that prevents treatment fluid from following along the path of re-injection water. The arrows 360 illustrate a representative path of the stimulating treatment. The check valves 302 can prevent the stimulation fluid from traveling into the oil/water separation 200, thereby potentially causing detrimental effects.

Figure 5:
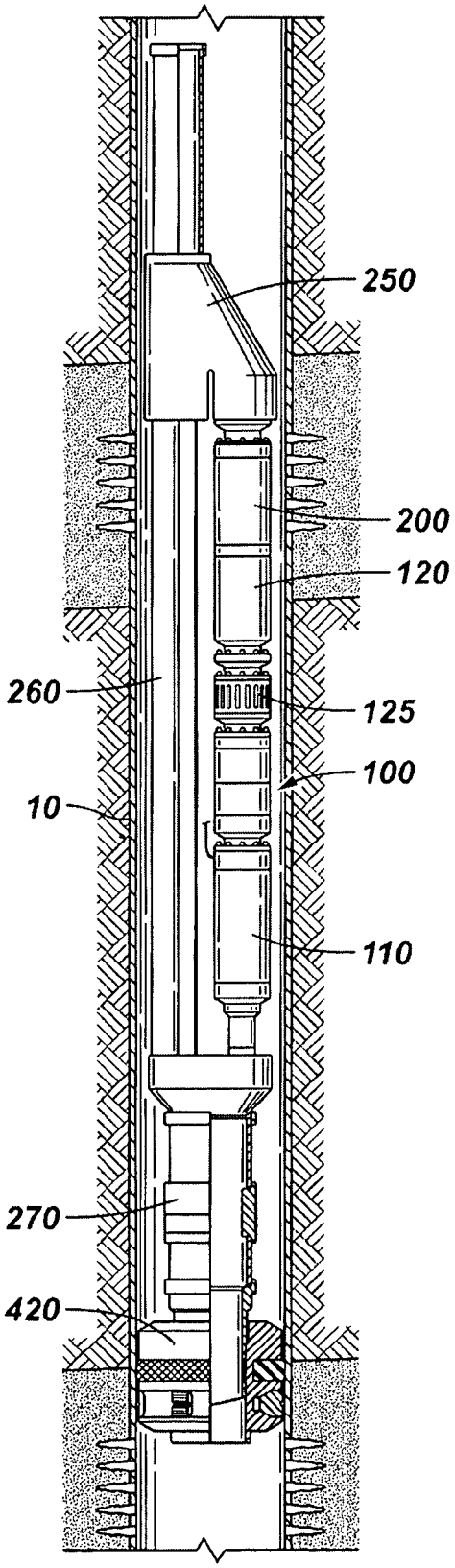
FIG. 5 illustrates another example of the well system, according to an alternate embodiment.

FIG. 5 shows a configuration to re-inject a water stream to a zone located below the producing zone. A motor 110, a pump 120, and an oil/water separator 200 are connected as before. A redirector 250 is connected uphole from the oil/water separator 200. The redirector 250 is connected to a conduit 260 that extends downhole from the re-injection and through a packer 420. The packer 420 separates a production area that is uphole from the packer 420, from a re-injection area that is downhole from the packer 420. In this embodiment, the water stream travels through a tailpipe assembly 270. The tailpipe assembly 270 extends though the packer 420 into the re-injection area that is downhole from the packer 420.

Figure 6:
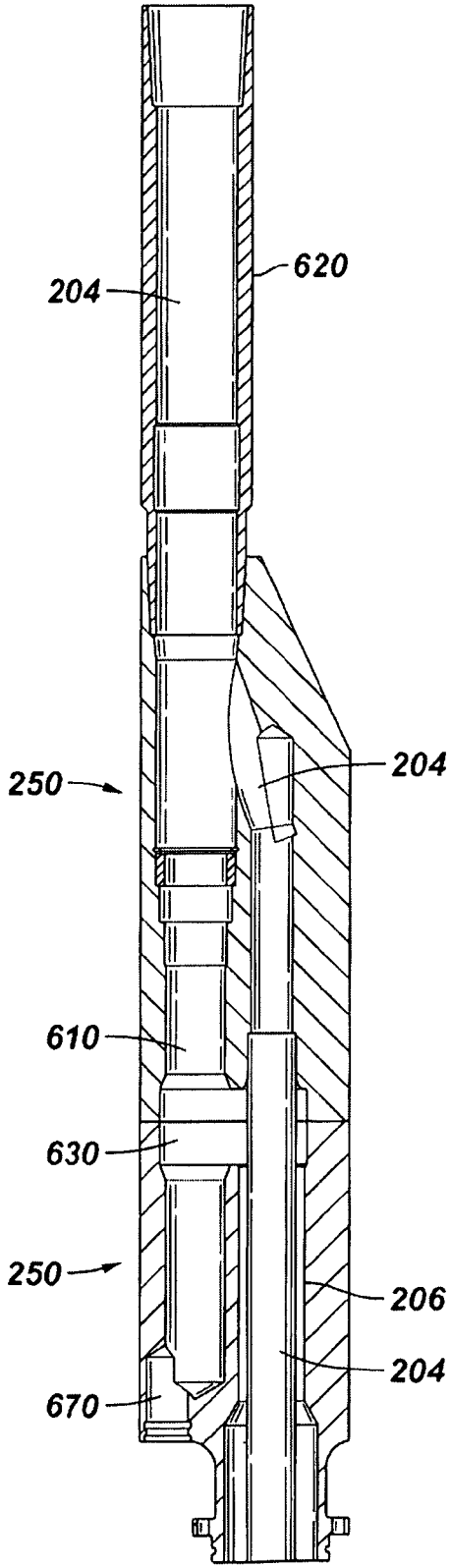
FIG. 6 is a cross-sectional view of another portion of the well system, according to an embodiment.
Figure 9:
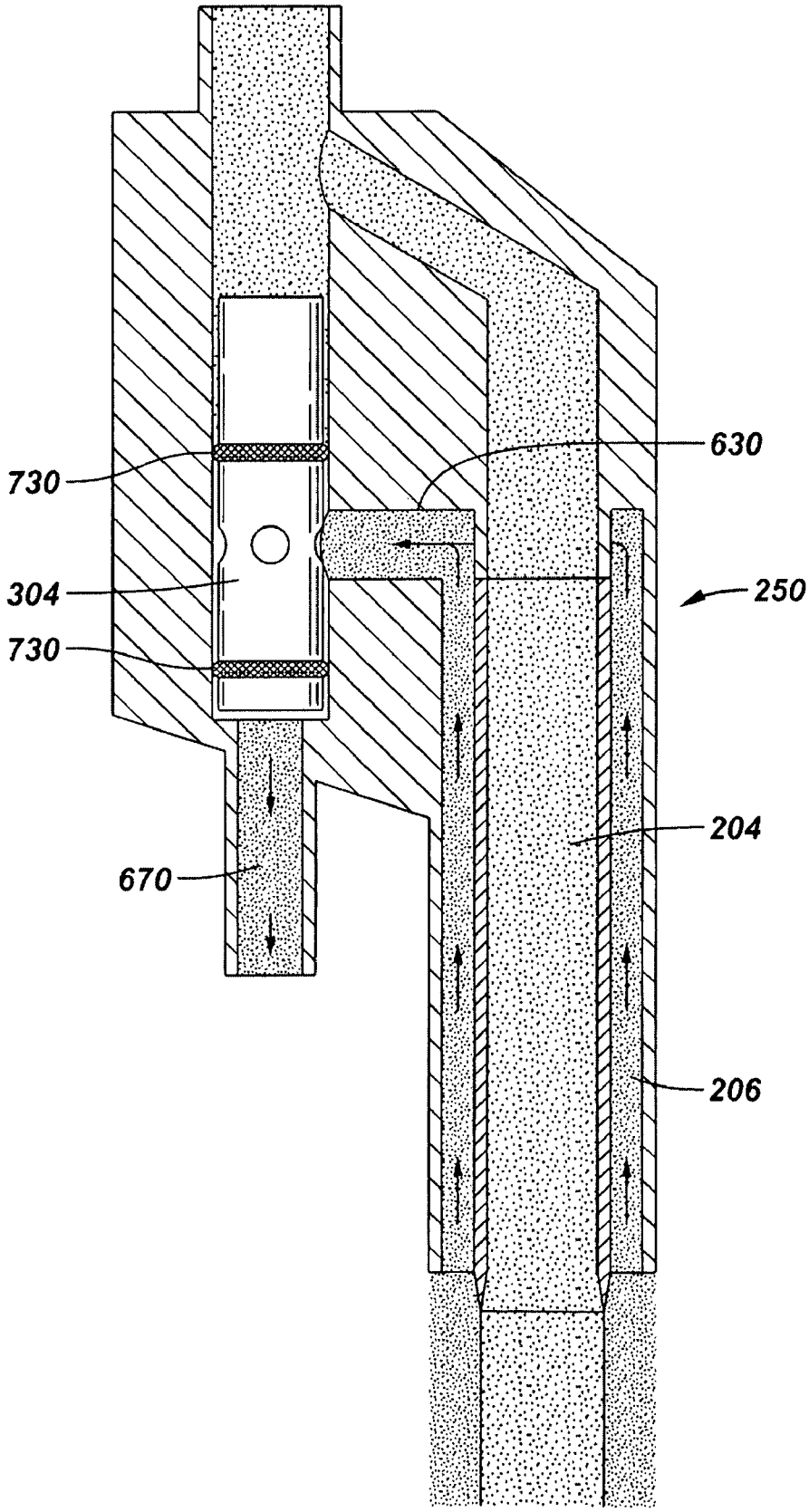
FIG. 9 is cross-sectional view of another portion of the well system, according to an embodiment.

FIG. 6 shows a more detailed cross section of an embodiment of the redirector 250. FIG. 9 shows a cross section of a redirector 250 and a flow-restrictor 304 in operation with the flow-restrictor 304 positioned in the flow-restrictor pocket 610. The flow-restrictor pocket 610 is configured to receive a flow-restrictor 304. The water conduit 206 is configured to be radially outside the oil conduit 204, i.e., a centrifugal oil/water separation. The oil conduit 204 extends from downhole of the redirector 250, through the redirector 250, and uphole past the redirector 250, where the oil conduit 204 connects with production tubing 620 (e.g., coil tubing). The water conduit 204 extends from below the redirector 250 and into the redirector 250. The water conduit 204 merges into a water passage 630 that connects the water conduit 204 with the flow-restrictor pocket 610. The water passage 630 can extend in a direction substantially perpendicular to the water conduit 204 proximate to the water passage. That is, during operation, the flow of the water makes approximately a 90 degree turn. The water can alternately make as little as approximately a 45 degree turn and as much as approximately a 135 degree turn. A re-injection passage 670 extends from the flow-restrictor pocket 610 downhole past the redirector 250. The re-injection passage 670 can be connected with completion tubing or other tubing.

Figure 7:
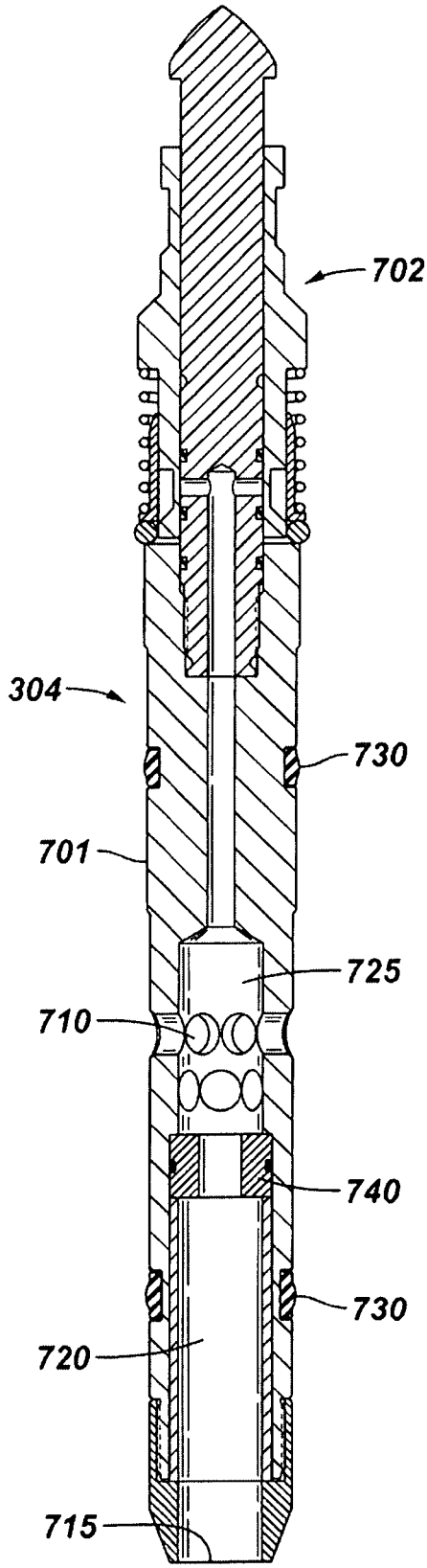
FIG. 7 is cross-sectional view of another portion of the well system, according to an embodiment.

FIG. 7 shows one embodiment of the flow-restrictor 304. The flow-restrictor 304 has a body 701 that defines therein an upper inner chamber 725 and a lower inner chamber 720. The upper inner chamber 725 and the lower inner chamber 720 are divided by a flow-restriction orifice 740. The flow-restriction orifice 740 and the body 701 can be the same part, or two separate parts fit together. In this example, the flow-restriction orifice 740 has a narrower diameter in a longitudinal axial direction than either the upper inner chamber 725 or the lower inner chamber 720. However, the diameter of the flow-restriction orifice 740 can be essentially the same diameter of either the upper inner chamber 725 or the lower inner chamber 720. Passages 710 are located in the body 701 and hydraulically connect the upper inner chamber 725 with an outside of the flow-restrictor 304. Passage 715 is on the downhole end of the flow-restrictor 304. When the flow-restrictor 304 is in position in the flow-restrictor pocket 610, the passages 710 allow fluid to pass from the water passage 630, though the passages 710 and into the upper inner chamber 725. The fluid then flows through the restrictor orifice 740, into the lower inner chamber 720 and out of the flow-restrictor 304 for re-injection. It should be noted that the flow-restrictor 304 can have many internal configurations, so long as the flow is adequately restricted/throttled.

The flow-restrictor 304 may have an attachment part 702 that is used to connect to a downhole tool (not shown) to place and remove the flow-restrictor 304 from the flow-restrictor pocket 610. As noted earlier, the downhole tool can be connected to any relay apparatus, e.g., wireline, slickline, or coiled tubing.

There are many ways to determine an oil/water content of a well fluid. Well fluid can be delivered to surface where a determination can be made. Alternately, a sensor can be located downhole to determine the oil/water ratio in the well fluid. That determination can be transmitted uphole in many ways, e.g., electrical signals over a wire, fiber-optic signals, radio signals, acoustic signals, etc. Alternately, the signals can be sent to a processor downhole, the processor instructing a motor to set a certain orifice size for the flow-restrictor 304 based on those signals. The sensor can be located downstream from the well fluid intake of the oil/water separator, inside the oil/water separator, inside the redirector, inside the flow-restrictor, upstream of the oil/water separator, outside the downhole device and downhole of the well fluid intake, outside the downhole device and uphole of the sell fluid intake, or outside the downhole device and at the level of the well fluid intake.

Figure 8:
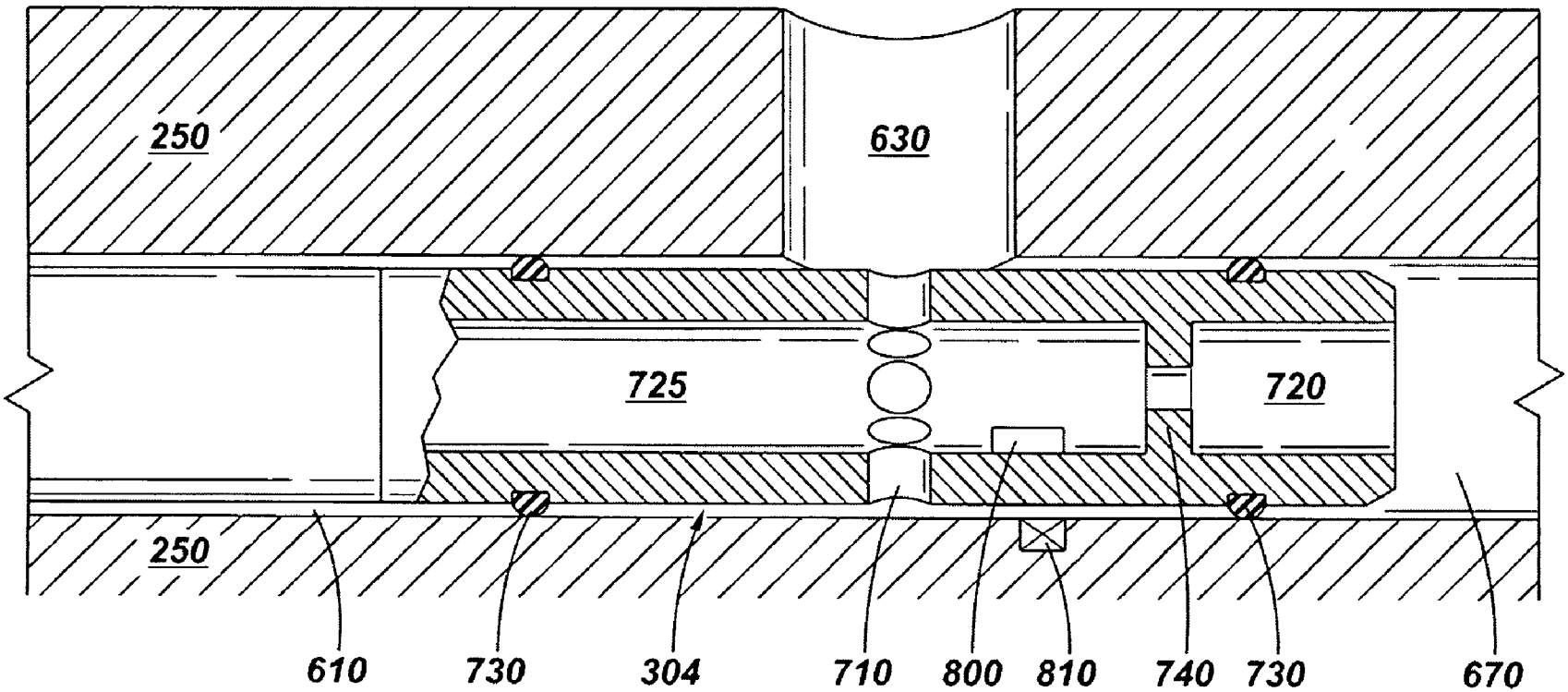
FIG. 8 is cross-sectional view of another portion of the well system, according to an embodiment.

One embodiment shown in FIG. 8 has a flow-restrictor 304 having a sensor 800 located in the upper inner chamber 725. The sensor could be in the lower inner chamber 720. The sensor 800 can sense temperature, flow rate, pressure, viscosity, or oil/water ratio. The sensor 800 can communicate by way of a telemetry pickup 810 that is integrated with the redirector 250. The sensor 800 can communicate through an electrical contact or "short-hop" telemetry with a data gathering system (not shown).

Figure 10:
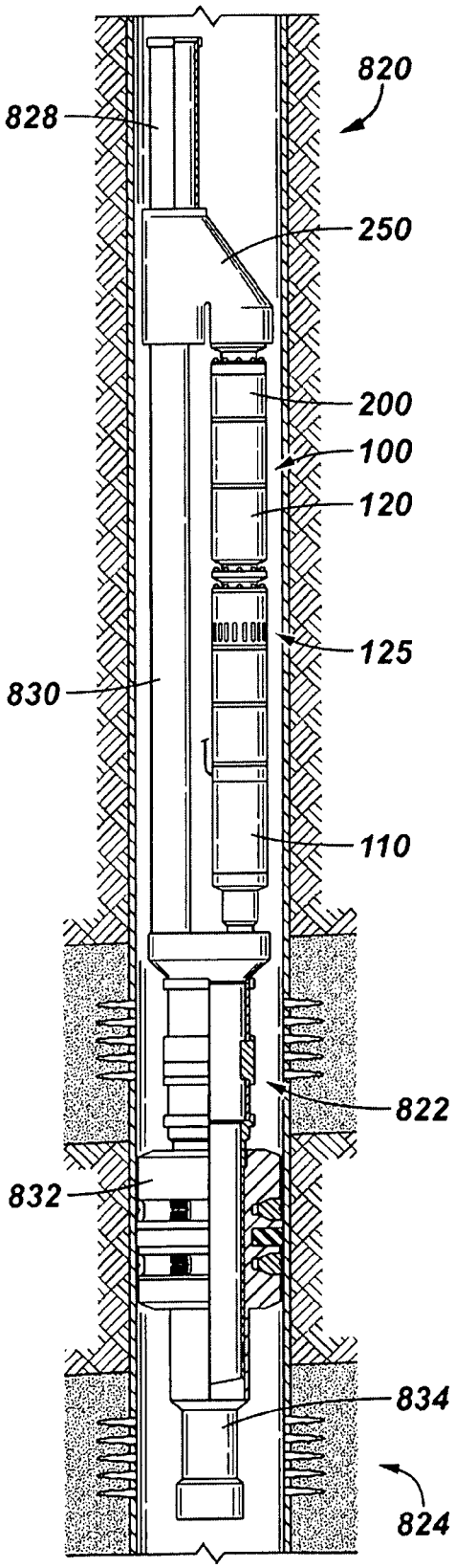
FIG. 10 is a front elevation view of another example of a well system for downhole fluid processing, according to an alternate embodiment.

Referring generally to FIG. 10, an embodiment of a well system 820, e.g. a downhole fluid processing system, is illustrated with a sensor system 822. In this embodiment, well system 820 has a configuration that enables the injection of a separated water stream into an injection zone 824 located below a production zone 826. Sensor system 822 comprises one or more sensors positioned to sense one or more desired characteristics related to the downhole processing of well fluid. Based on data provided by sensor system 822, adjustments can be made to optimize, for example, the production of oil and the injection of separated water. The adjustments may include changing back-pressure by adjusting the flow-restrictor 304, adjusting pump speed, adjusting the back pressure of the produced oil stream, or by adjusting various other operational parameters.

In operation, well fluid is drawn in through production zone 826 via electric submersible pumping system 100 which may comprise a variety of pumping system components. The well fluid is directed through separator 200 where it is separated into a water component and an oil component. It should be noted that the water component may comprise small amounts of oil and the oil component may comprise small or large amounts of water, and those amounts may be monitored to facilitate optimization of the fluid processing.

The separated fluids are directed into redirector 250 which directs the oil stream up through a tubing 828 while redirecting the water stream back down into the wellbore through tubing 830. In this embodiment, the sensor system 822 is located below the electric submersible pumping system 100. The water stream is directed down past sensor system 822, through a packer 832, and out through a discharge tubing 834 into injection zone 824. The packer 832 isolates the injection zone 824 from the production zone 826 along the wellbore. The sensor system 822 can measure a variety of characteristics related to the water component, but the sensor system 822 also may comprise sensors that detect and/or monitor various other characteristics related to the produced oil stream, the surrounding formation, the operation of well system components, or to other aspects of the fluid processing.

Figure 11:
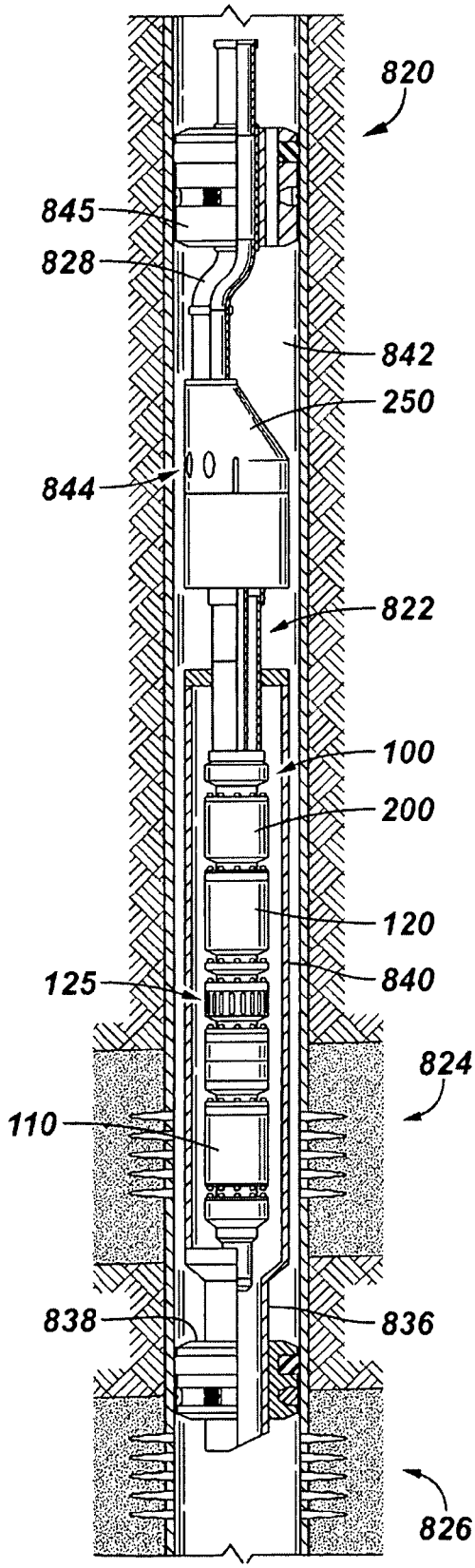
FIG. 11 is a front elevation view of another example of a well system for downhole fluid processing, according to an alternate embodiment.

In an alternate embodiment, well system 820 is arranged so the water component is injected into an injection zone 824 located above the production zone 826, as illustrated in FIG. 11. In this embodiment, sensor system 822 is formed as a sensor package located above the electric submersible pumping system 100. For example, the sensor system package may be located above the electric submersible pumping system 100 and below the redirector 250, as illustrated.

In operation, well fluid is again drawn in through production zone 826 via electric submersible pumping system 100. The well fluid is drawn in through an intake tubing 836 that extends through a packer 838 separating the production zone 826 from the upper injection zone 824. The intake tubing 836 is connected to a shroud 840, and the well fluid from production zone 826 is drawn into the shroud 840. Electric submersible pumping system 100 is located within shroud 840 to intake the well fluid and to direct the well fluid through separator 200 where it is separated into the water component and the oil component.

The separated fluids are then moved past sensor system 822 and into redirector 250 which directs the oil stream up through tubing 828 while discharging the water component into an annulus 842 via appropriate discharge ports 844. Upward movement of the water component is blocked by a packer 845 so that the water is forced downwardly along an exterior of shroud 840. The water component travels downwardly until being directed into injection zone 824.

Figure 12:
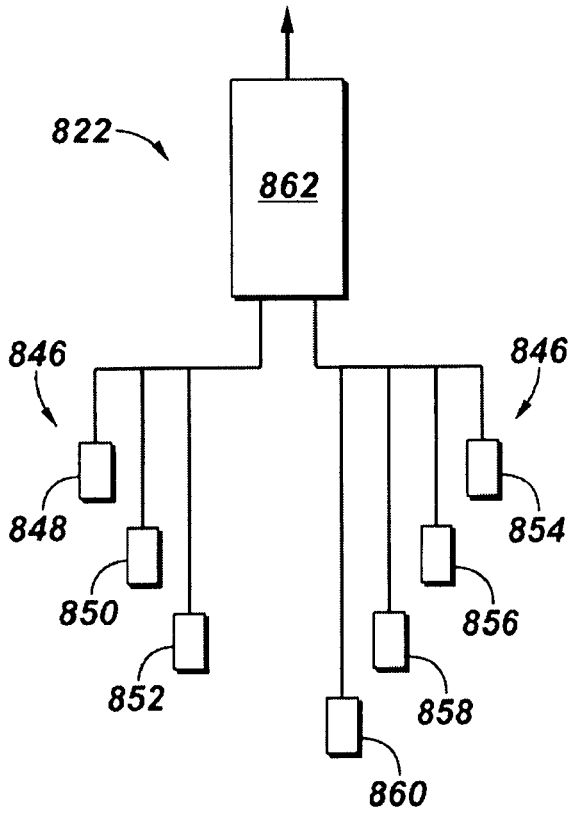
FIG. 12 is a schematic illustration of a variety of sensors that can be utilized in a sensor system for obtaining well characteristic data, according to an embodiment.

As illustrated schematically in FIG. 12, sensor system 822 may have a variety of configurations and include a variety of sensors 846. For example, sensor system 822 may be designed as a sensor package having a pressure sensor 848, such as an injection pressure sensor to measure the pressure of water being injected into injection zone 824. The sensor package also may comprise a flow rate sensor 850 and a vibration sensor 852, such as a three-axis vibration sensor. The sensors 848, 850, 852 may be located in a single package to measure parameters related to the water component, however the configuration may change depending on whether the injection of water is above the production zone or below the production zone. Additionally, pressure sensors, flow rate sensors, and vibration sensors also can be used to monitor the oil component.

Depending on the configuration of the overall well system, a variety of additional or alternate sensors 846 also can be utilized with sensor system 822. For example, an oil-in-water sensor 854 may be used to monitor the oil content in the injected water stream. Additionally, a particulate sensor 856, such as a sand-in-water sensor, can be used to monitor the amount of sand entrained in the water component to enable operational adjustments of well system 820. Other examples of sensors that may be utilized in sensor system 822 include a temperature sensor 858 and a chemical/composition sensor 860. Sensors 858 and 860 are located, for example, along one or both of the water stream and the oil stream to track fluid characteristics for optimization of the fluid downhole processing, as discussed above.

The various sensors detect and/or monitor the desired characteristics and output data to a suitable data relay 862 used to transfer data to, for example, a surface location for analysis and operational adjustment. The data obtained by sensors 846 can be transmitted to the surface in real-time for real-time analysis to enable rapid adjustment of well system operation. In one embodiment, the data relay 862 comprises an electric submersible pumping gauge positioned at a suitable location, such as a base of the submersible motor 110. The electric submersible pumping gauge may be used to communicate data to and/or from the surface through the power cable used to power motor 110. Alternatively, data relay 862 may comprise a cable-to-surface system which transmits data to and/or from a surface location via a separate cable run downhole. However, some or all of the sensors can have dedicated communication lines.

Figure 13:
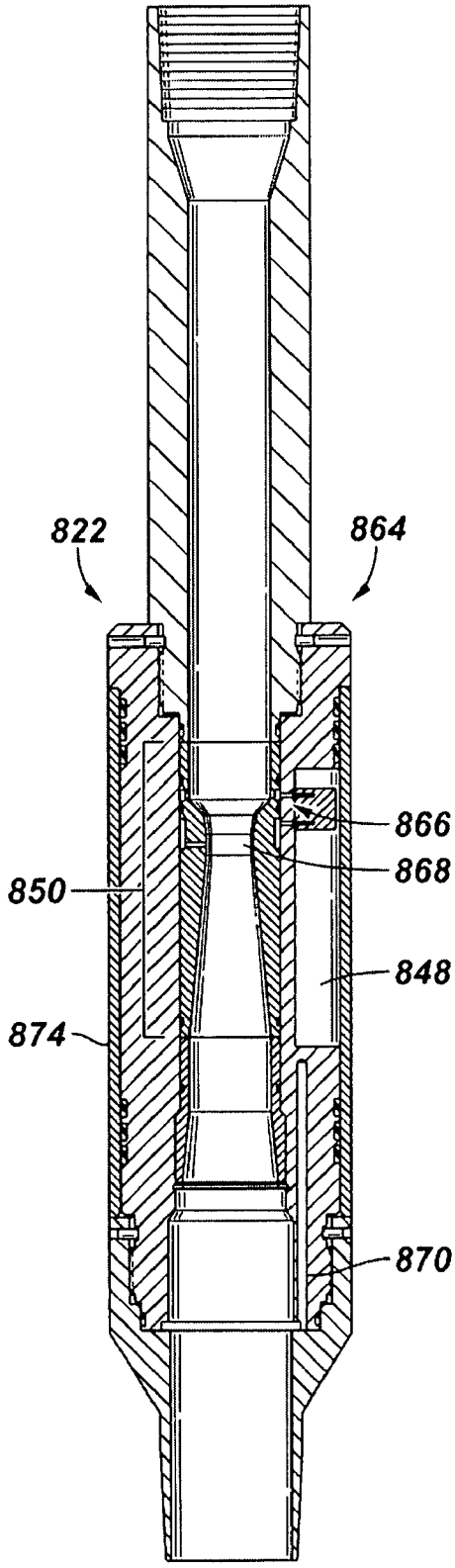
FIG. 13 is a cross-sectional view of one example of a flowmeter, according to an embodiment.

Referring generally to FIG. 13, one example of at least a portion of sensor system 822 is illustrated for use with a well system 820, such as the well system illustrated in FIG. 10 for injecting separated water into an injection zone below the production zone. In this example, sensor system 822 comprises a sensor package 864 positioned along the flow path of the water stream on its way to injection zone 824. The sensor package 864 comprises flow rate sensor 850 in the form of a flow meter 866. By way of example, flow meter 866 may comprise a differential pressure sensor in which the flow of fluid undergoes a velocity change, and therefore a pressure change, as it flows through a venturi nozzle 868. There is a characteristic dP versus flow rate characteristic that occurs with single phase fluids.

The sensor package 864 also comprises pressure sensor 848 which can be exposed to pressure in the tubing via a pressure port 870. In this particular example, a differential pressure sensor is used instead of two absolute pressure sensors. It should be noted that a variety of the other sensors 846, discussed above, may be incorporated into the sensor package 864 or can be positioned at other locations along well system 820 to detect and/or monitor desired characteristics related to the downhole fluid processing.

Figure 14:
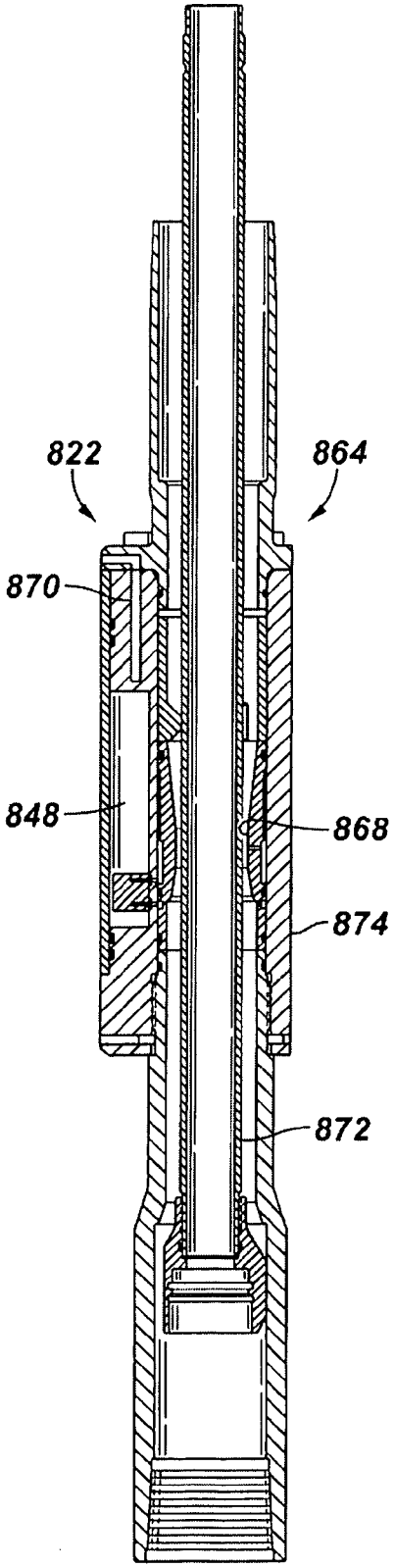
FIG. 14 is a cross-sectional view of another example of a flowmeter, according to an alternate embodiment.

A similar sensor package 864 is illustrated in FIG. 14 and is particularly amenable to use in a well system 820, such as the well system illustrated in FIG. 11, in which the water is injected into an injection zone 824 located above the production zone 826. In this particular example, a concentric tubing 872 is positioned through the venturi 868 to create concentric flow passages. The pressure sensor 848 and the pressure port 870 are arranged such that the pressure measurement is taken outside of the sensor housing. Again, a variety of the other sensors discussed above may be incorporated into the sensor package 864 or can be positioned at other locations along well system 820 to detect and/or monitor desired characteristics related to the downhole fluid processing.

Additionally, sensor package 864 and other sensors can be packaged and arranged in a variety of configurations. For example, additional sensors 846 may be mounted in a housing 874 of the sensor package 864/flow meter 866. The housing 874 is made larger, as necessary, to incorporate multiple sampling ports for the various sensors. The various sensors within housing 874 may be connected to data relay 862 to enable transfer of data to the surface via a single connection. In other embodiments, individual sensors or groups of sensors may be mounted in separate electronics housings with, for example, separate communication lines.

In another example, one or more of the sensors 846 is positioned as an integral part of a flow control manifold, e.g. redirector 250 or an injection valve. In this example, the sensor sampling locations may be housed inside the flow control manifold rather than in a separate, stand-alone housing. When water is injected in a lower injection zone, the flow control manifold can be either an upper or a lower manifold. In other applications, the sensors can be installed inside a sensor carrier located in a concentric seal bore with a retrievable injection valve. In this example, the sensor carrier may be retrieved periodically to place new sensors in the completion. Telemetry with the sensor carrier may be accomplished via "short hop" telemetry or through some other contact based telemetry pickup. By way of further example, the sensors may be located inside an injection valve without the addition of a separate sensor carrier.

Figure 15:
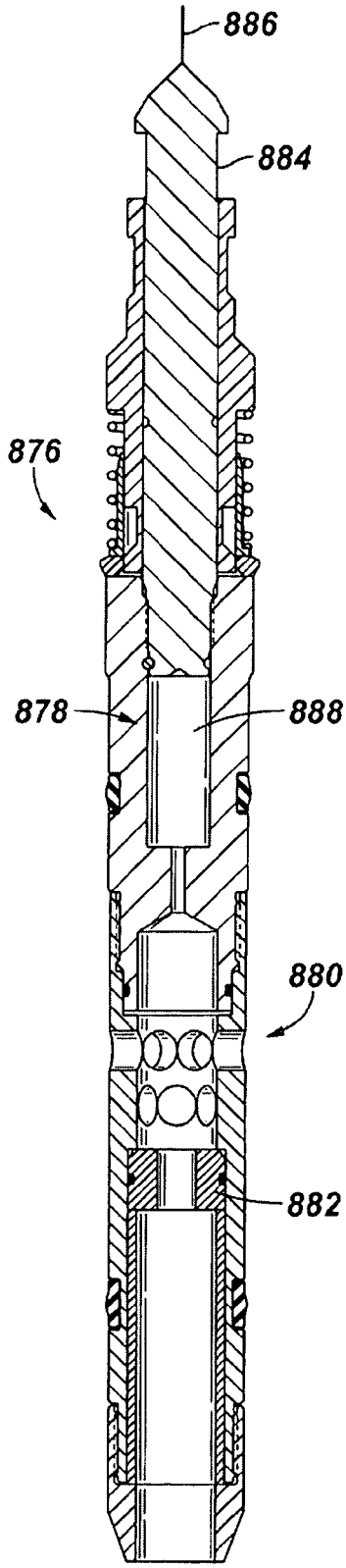
FIG. 15 is a cross-sectional view of one example of a sampling chamber system, according to an embodiment.

In addition to remote measurement of flow characteristics with sensors 846, the well system 820 also may utilize systems for taking samples of fluid, such as samples of the injected fluid. As illustrated in FIG. 15, a sampling system 876 may be used to enable periodic fluid sampling. By way of example, sampling system 876 comprises a sampling chamber structure 878 in selective fluid communication with a flow control manifold 880 having a flow control valve 882. The flow control valve 882 may be selectively actuated to enable introduction of a fluid sample into sampling chamber 878. In this example, the sampling system 876 is located along the flow path of the water stream to control the flow and the sampling of injection fluid.

For some embodiments, the sampling chamber 878 may be activated by a wireline or another suitable conveyance that extends to the surface. In one example, a tool 884 is designed to engage the sampling chamber structure 878 to enable placement and retrieval of the sampling chamber structure via a wireline 886 or another suitable mechanism. By way of example, the sampling chamber 878 may comprise a sampling tube that is pulled to the surface from the flow control manifold 880 to allow periodic fluid sampling.

In other embodiments, the sampling chamber 878 is formed as part of the flow control valve 882 which can be retrieved to bring small amounts of injection fluid to the surface via, for example, wireline techniques. In some applications, the sampling chamber 878 may be run downstream in a concentric seal bore to an injection valve. After being installed and after allowing the well system to operate under normal conditions for a period of time, e.g. one to two days, the sample chamber can be retrieved via wireline or other suitable technique.

The sampling chamber 878 also may comprise a variety of internal elements 888 to facilitate sampling and evaluation of the sample fluid. For example, the internal elements may comprise filter material to filter out solids or special electrolytic metals to collect specific ions or to check the pH value of the injection fluid stream. The internal elements 888 also may comprise a filter material to collect oil droplets for facilitating analysis of the oil-in-water concentration. By way of further example, the sample chamber can comprise sensors to provide a live, real-time connection to the surface for fluid sample analysis at the surface.

Figure 16:
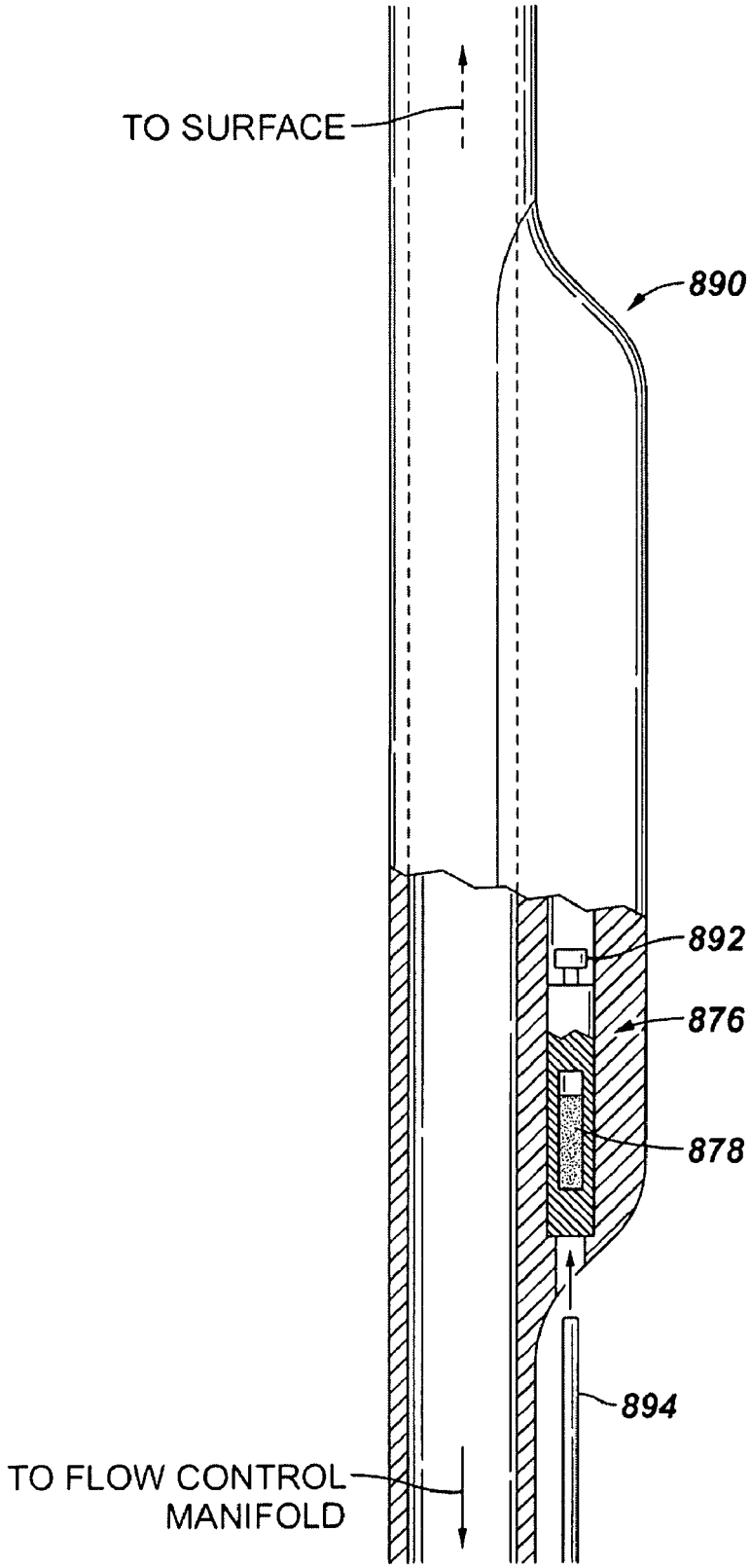
FIG. 16 is a cross-sectional view of another example of a sampling chamber system, according to an embodiment.

Referring generally to FIG. 16, another example of sampling system 876 is illustrated. In this example, sampling chamber structure 878 is located in a side pocket mandrel 890 along the appropriate flow tubing, e.g. the water injection tubing. The side pocket mandrel 890 may be similar to a gas lift mandrel, and the sample chamber 878 may be similarly retrieved with the aid of wireline, slickline, a kickover tool, or other suitable mechanism. Retrieval may be facilitated with a suitable connector 892 connected to the sample chamber 878. In this embodiment, injection fluid is delivered to an interior of sample chamber structure 878 via an appropriate control line 894 that may be connected between the side pocket mandrel and a flow control manifold, such as flow control manifold 880 in the previously described embodiment. A sample of injection fluid may be selectively delivered to sample chamber 878 and then retrieved to the surface. In some applications, the sampling is conducted on a periodic basis by repeatedly replacing and retrieving a sample chamber.

The embodiments described above provide examples of well systems that can be used to facilitate downhole fluid processing. The various sensor systems enable a wide variety of data to be obtained on the separation and injection of fluids downhole even when the injection fluid is not pumped to the surface. Furthermore, the sensor system can be designed to enable real-time analysis of downhole characteristics for some or all of the characteristics monitored. Regardless, the data obtained via the sensor system 822 enables improved adjustment to the operation of well system 820 to better optimize the fluid processing. For example, the data can be used to adjust back pressure via flow-restrictor 304 or to perform other actions that limit risk and/or improve the efficiency of operation. Furthermore, a wide variety of components can be utilized in sensor system 822 and in the overall well system 820.

Accordingly, although only a few embodiments have been described in detail above, those of ordinary skill in the art will readily appreciate that many modifications are possible without materially departing from the teachings of this application. Such modifications are intended to be included within the scope as defined in the claims.

What is claimed is:

1. A downhole device, comprising:

an oil/water separator device having a well fluid inlet, an oil stream outlet conduit, and a water stream outlet conduit;

a removable flow-restrictor located in at least one of the water stream outlet conduit or the oil stream outlet conduit;

the removable flow-restrictor being removable from the downhole device while downhole by a downhole tool relayed by at least one selected from a group consisting of: wireline, slickline and coil tubing; and a sensor package positioned downhole in communication with at least one of the water stream outlet conduit or the oil stream outlet conduit.

2. The downhole device of claim 1, wherein the removable flow-restrictor has a fixed throttle orifice and the orifice size in the downhole device is changed by interchanging flow-restrictors.

3. The downhole device of claim 1, wherein the removable flow-restrictor has a removable throttle orifice and the orifice size is changed by interchanging throttle orifices.

4. The downhole device of claim 1, wherein the water stream outlet conduit opens up into a wellbore at a point farther downhole than a pump.

5. The downhole device of claim 1, wherein the removable flow-restrictor has a throttle part with a variable inside diameter.

6. A method of downhole fluid processing, comprising:

separating a downhole fluid into an oil stream and a water stream at a downhole location;

restricting flow of at least one of the oil stream or the water stream with a first flow-restrictor and in a manner to facilitate separation;

sensing characteristics of at least one of the oil stream or the water stream; and replacing, at a downhole location, the interchangeable flow-restrictor with a different interchangeable flow-restrictor by way of one selected from a group consisting of: wireline, slickline and coil tubing;

the different interchangeable flow restrictor being selected based on the sensed characteristic.

7. The method as recited in claim 6, further comprising injecting the water stream into a downhole injection zone.

8. The method as recited in claim 7, further. comprising producing the oil stream to a surface location with the aid of an electric submersible pumping system.

9. The method as recited in claim 6, wherein utilizing comprises controlling restriction of flow based on the sensed characteristics.

10. The method as recited in claim 6, wherein sensing characteristics comprises sensing and relaying data in real-time.

11. The method as recited in claim 7, wherein sensing characteristics comprises sensing injection pressure of the water stream.

12. The method as recited in claim 6, wherein sensing characteristics comprises sensing at least one of flow rate of the water stream or the flow rate of the oil stream.

13. The method as recited in claim 6, wherein sensing characteristics comprises sensing three-axis vibration.

14. The method as recited in claim 6, wherein sensing comprises monitoring fluid composition.

15. The method as recited in claim 6, further comprising collecting fluid samples in a sampling chamber.

* * * * *